US007432641B2

(12) United States Patent
Nunome

(10) Patent No.: US 7,432,641 B2
(45) Date of Patent: Oct. 7, 2008

(54) SPARK PLUG

(75) Inventor: Kenji Nunome, Aichi (JP)

(73) Assignee: NGK Spark Plug Co. Ltd., Nagoya (JP)

( * ) Notice: Subject to any disclaimer, the term of this patent is extended or adjusted under 35 U.S.C. 154(b) by 0 days.

(21) Appl. No.: 11/686,128

(22) Filed: Mar. 14, 2007

(65) Prior Publication Data

US 2007/0222351 A1 Sep. 27, 2007

(30) Foreign Application Priority Data

Mar. 21, 2006 (JP) ..... 2006-077857

(51) Int. Cl.
*H01T 13/20* (2006.01)

(52) U.S. Cl. ..... 313/141; 313/143

(58) Field of Classification Search ..... 313/118–145; 123/169 R, 169 EL, 32, 41, 310
See application file for complete search history.

(56) References Cited

U.S. PATENT DOCUMENTS 6,310,430 B1 * 10/2001 Moriya ..... 313/141
2002/0067111 A1 * 6/2002 Shibata et al. ..... 313/141
2006/0202599 A1 * 9/2006 Kato ..... 313/143

FOREIGN PATENT DOCUMENTS

JP 2001176637 6/2001

* cited by examiner

*Primary Examiner*—Mariceli Santiago
*Assistant Examiner*—Donald L Raleigh
(74) *Attorney, Agent, or Firm*—Brinks Hofer Gilson & Lione

(57) ABSTRACT

A plurality of insulator samples of different dimensions are subjected to multiple regression analysis to thereby induce an expression for estimating the amount of unevenness in wall thickness of an insulator; specifically, 0.01 (17.527+0.141A−0.285B−6.124C−0.14D+1.105E), where A is an overall length of the insulator, B is the outside diameter of a rear trunk portion of the insulator, C is the diameter of a large diameter portion of the axial bore of the insulator, D is the length of the large diameter portion of the bore, and E is the diameter of a small diameter portion of the axial bore. The insulator is designed such that the amount of unevenness in wall thickness thereof estimated through calculation by this expression is less than 0.07 mm.

3 Claims, 6 Drawing Sheets

SPARK PLUG

BACKGROUND OF THE INVENTION

The present invention relates to a spark plug for igniting fuel in an internal combustion engine.

Conventionally, spark plugs have been used for igniting fuel in internal combustion engines of automobiles and the like. In a typical spark plug, an insulator having an axial bore holds a center electrode in a front end portion of the axial bore, and an electrical terminal in a rear end portion of the axial bore. A metallic shell holds the insulator therein while surrounding a trunk portion thereof. One end of a ground electrode is welded to a front end surface of the metallic shell and the other end of the ground electrode is bent so as to face the center electrode, thereby forming a spark discharge gap therebetween. A spark discharge is induced across the spark discharge gap.

An insulator of such a spark plug is manufactured in the following manner. First, a material powder which predominantly contains electrically insulative ceramic, such as alumina, is rubber-pressed into a green compact having a preliminary shape of the insulator. Since a press pin is set in a rubber mold for rubber pressing, a through-hole is formed in the green compact. The through-hole becomes the axial bore of the insulator. Next, a support pin is inserted into the through-hole of the green compact from the proximal end of the green compact. The support pin is fixed at its proximal end on a manufacturing apparatus. The green compact is rotatably supported by the support pin. A grindstone is caused to abut the green compact from a direction perpendicular to the axis of the insulator. The grindstone grinds the outer surface of the green compact, thereby forming a preform having the profile of the insulator. Subsequently, the preform undergoes firing, marking, glazing, glost firing, and the like, whereby the insulator is completed (refer to, for example, Japanese Laid-Open Patent Application (kokai) No. 2001-176637).

In recent years, automobile engines have provided increasingly high output with reduced fuel consumption. Under such circumstances, in order to ensure the necessary degree of freedom in designing engines, a reduction in the size of spark plugs has been demanded. In order to reduce the size of a spark plug, the diameter of a metallic shell must be reduced which, of course, requires reducing the diameter of the insulator held in the metallic shell. Such size reductions potentially involve a failure to impart sufficient strength and insulating properties to the insulator. In order to avoid this problem, the diameter of the axial bore of the insulator may be reduced so as to increase the wall thickness of the insulator (the distance between the outer circumferential surface of the insulator and the wall surface of the axial bore). This is accompanied by a reduction in the diameter of the support pin which is used in the process of manufacturing the insulator.

However, in a step of grinding a green compact in the process of manufacturing the insulator, using a support pin whose diameter is smaller than that used in conventional practice raises a problem that the support pin is deflected by the stress induced by contact between the green compact and the grindstone. Particularly, when an insulator having an overall (axial) length of 65 mm or more is to be manufactured, a support pin must be elongated accordingly. As compared with the case of manufacturing an insulator having a short overall length, the barycenter of the insulator is biased more toward a distal end of the insulator. As a result, stress tends to concentrate on a proximal end portion of the support pin to be fixed on the manufacturing apparatus. Grinding a green compact with the support pin being deflected causes a large positional deviation (a large degree of eccentricity or run out) of the center of the through-hole from the center of the outer circumference, particularly at the distal end of the preform. Thus, the wall thickness of the preform is uneven. If an insulator from the preform is attached to a metallic shell, the distance between the outer surface of a thick-walled portion of the insulator and the inner circumferential surface of the metallic shell becomes short, potentially resulting in occurrence of lateral sparks therebetween.

SUMMARY OF THE INVENTION

An object of the present invention is to solve the above-mentioned problem and to provide a spark plug whose insulator enables use of a deflection-reduced support pin in a manufacturing process therefor and thus has an eccentricity-suppressed axial bore, thereby preventing occurrence of lateral sparks.

To achieve the above object, a spark plug according to the present invention comprises an insulator having a bore or hole extending in an axial direction, which holds a center electrode for generating spark discharge in a front end portion of the axial bore and a connection terminal, electrically connected to the center electrode, in a rear end portion of the axial bore. The axial bore of the insulator comprises a large diameter portion continuous with an opening located at the rear end of the axial bore and a small diameter portion continuous with the front end of the large diameter portion and smaller in diameter than the large diameter portion. An axial length A (in mm) of the insulator, an outside diameter B (in mm) of a rear trunk portion located rearward of a portion of the insulator having a maximum outside diameter, a diameter C (in mm) of the large diameter portion, an axial length D (in mm) of the large diameter portion, and a diameter E (in mm) of the small diameter portion satisfy the inequalities $A \geqq 65$, $E \leqq 3.4$, and $0.01(17.527+0.141A-0.285B-6.124C-0.14D+1.105E) < 0.07$.

In a process of manufacturing an insulator of a spark plug, the outer periphery of a green compact is ground to produce a preform of the insulator having the desired profile. In this grinding step, a support pin whose proximal end is fixed on a manufacturing apparatus is inserted into a through-hole of the green compact (corresponding to an axial bore of the completed insulator), and the green compact which is thus supported by the support pin is caused to abut a grindstone, whereby the green compact is formed into a desired shape by grinding. According to the spark plug of the present invention, dimensions of a completed insulator are specified, whereby dimensions of a support pin for use in manufacturing the insulator can be specified. This allows the support pin to assume such dimensions as to enhance rigidity thereof. Thus, the support pin can be designed to be unlikely to deflect during grinding of the green compact, thereby effectively suppressing eccentricity of the axial bore of the completed insulator which could otherwise arise by grinding the green compact supported by a deflected support pin.

In specifying dimensions of the completed insulator, the present invention uses an expression for estimating the amount of unevenness in wall thickness (degree of eccentricity of the axial bore) of the insulator which is induced by multiple regression analysis; specifically, $0.01(17.527+0.141A-0.285B-6.124C-0.14D+1.105E)$, where A is an overall length, B is the outside diameter of the rear trunk portion, C is the diameter of the large diameter portion, D is the length of the large diameter portion, and E is the diameter of the small diameter portion. By designing an insulator whose amount of unevenness in wall thickness estimated by use of the expression is less than 0.07, a support pin for use in manufacturing the insulator can be reduced in deflection. Thus, the eccentricity of the axial bore of the thus-manufactured insulator can be suppressed. A spark plug which is manufactured by use of this insulator can be free from occurrence of lateral sparks.

In connection with reduction in the size of an insulator for reducing the size of a spark plug, the present invention reduces the eccentricity of the axial bore of the insulator which could otherwise arise in the process of manufacturing the insulator. Therefore, the present invention is applied to those insulators which may be accompanied, in the course of manufacture thereof, by deflection of corresponding support pins used in the manufacturing process; specifically, those insulators which have an overall length A of 65 mm or more and a diameter E of a small diameter portion of an axial hole of 3.4 mm or less.

Another spark plug according to the present invention comprises an insulator having a bore extending in an axial direction, and holding a center electrode for generating spark discharge in a front end portion of the axial bore and a connection terminal, electrically connected to the center electrode, in a rear end portion of the axial bore. The axial bore of the insulator comprises a large diameter portion continuous with an opening located at a rear end of the axial bore and a small diameter portion continuous with a front end of the large diameter portion and smaller in diameter than the large diameter portion. An axial length A (in mm) of the insulator, an outside diameter B (in mm) of a rear trunk portion located rearward of a portion of the insulator having a maximum outside diameter, a diameter C (in mm) of the large diameter portion, an axial length D (in mm) of the large diameter portion, and a diameter E (in mm) of the small diameter portion satisfy the inequalities and ratios: $A \geqq 65$, $E \leqq 3.4$, $C/E \geqq 1.16$, $C/B \leqq 0.47$, and $D/A \geqq 0.09$. As viewed on a plane which is perpendicular to the axial direction and on which a front end face of the insulator is projected, a distance between the center of a projected outer circumference of the front end face of the insulator and the center of a projected circumference of the opening of the axial bore is less than 0.07 mm.

According to the above spark plug of the present invention, dimensions of a completed insulator are specified so as to specify dimensions of a support pin for use in manufacturing the insulator for making the support pin not prone to deflect. Specifically, by specifying $C/E \geqq 1.16$, a proximal end portion of the support pin which is fixed on a manufacturing apparatus at the time of grinding a green compact and on which internal stress is likely to concentrate can be increased in outside diameter. Also, specifying $C/B \leqq 0.47$ can avoid the wall thickness of the completed insulator as measured at the large diameter portion of the axial hole becoming too small as a result of increasing the diameter of the proximal end portion of the support pin. Furthermore, specifying $D/A \geqq 0.09$ can impart a sufficient length to the proximal end portion of the support pin whose outside diameter is increased, thereby enhancing strength of the proximal end portion. Thus, the resultant support pin becomes unlikely to deflect. By specifying dimensions of the insulator as mentioned above, deflection of the support pin can be reduced, thereby suppressing eccentricity of the axial bore of the insulator to be manufactured. A spark plug which is manufactured by use of the insulator whose amount of unevenness in wall thickness (degree of eccentricity of the axial bore) is less than 0.07 mm can be free from occurrence of lateral sparks.

DESCRIPTION OF THE PREFERRED EMBODIMENT

Figure 1:
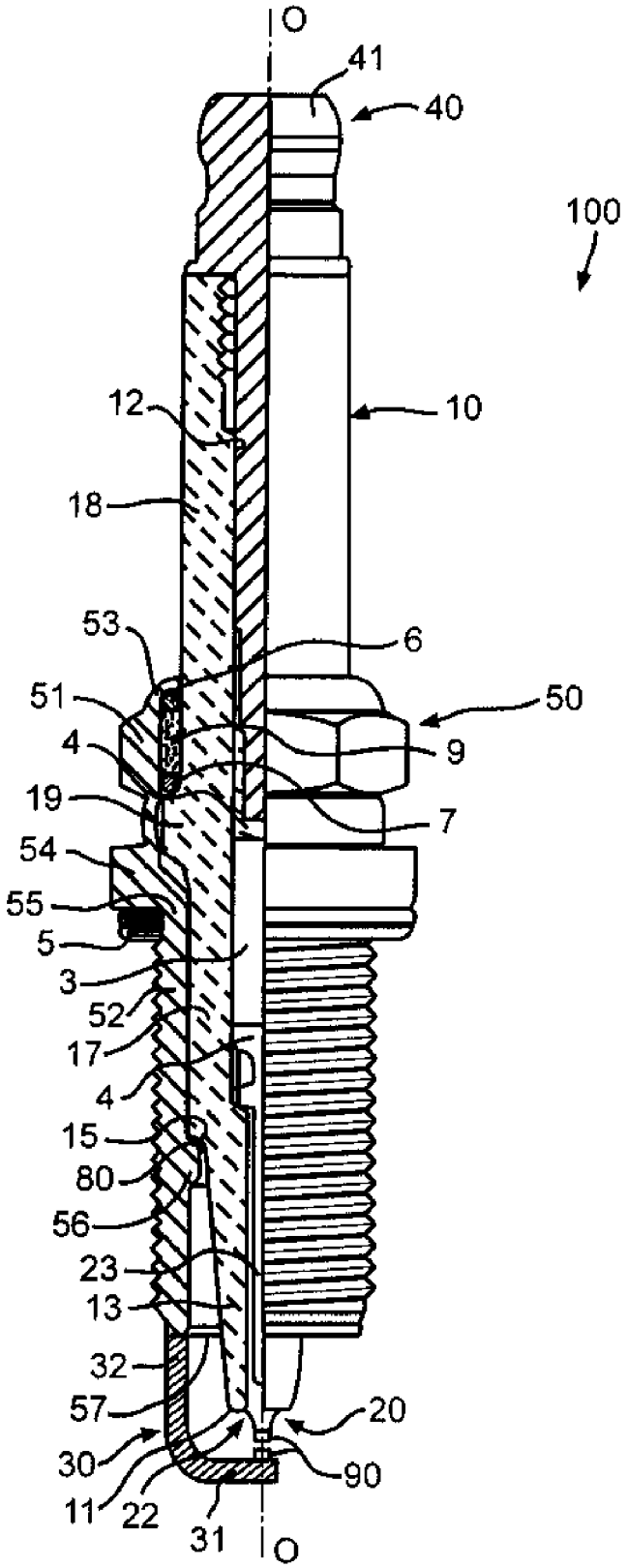
FIG. 1 is a side elevational view in half section of a spark plug according to the present invention.
Figure 2:
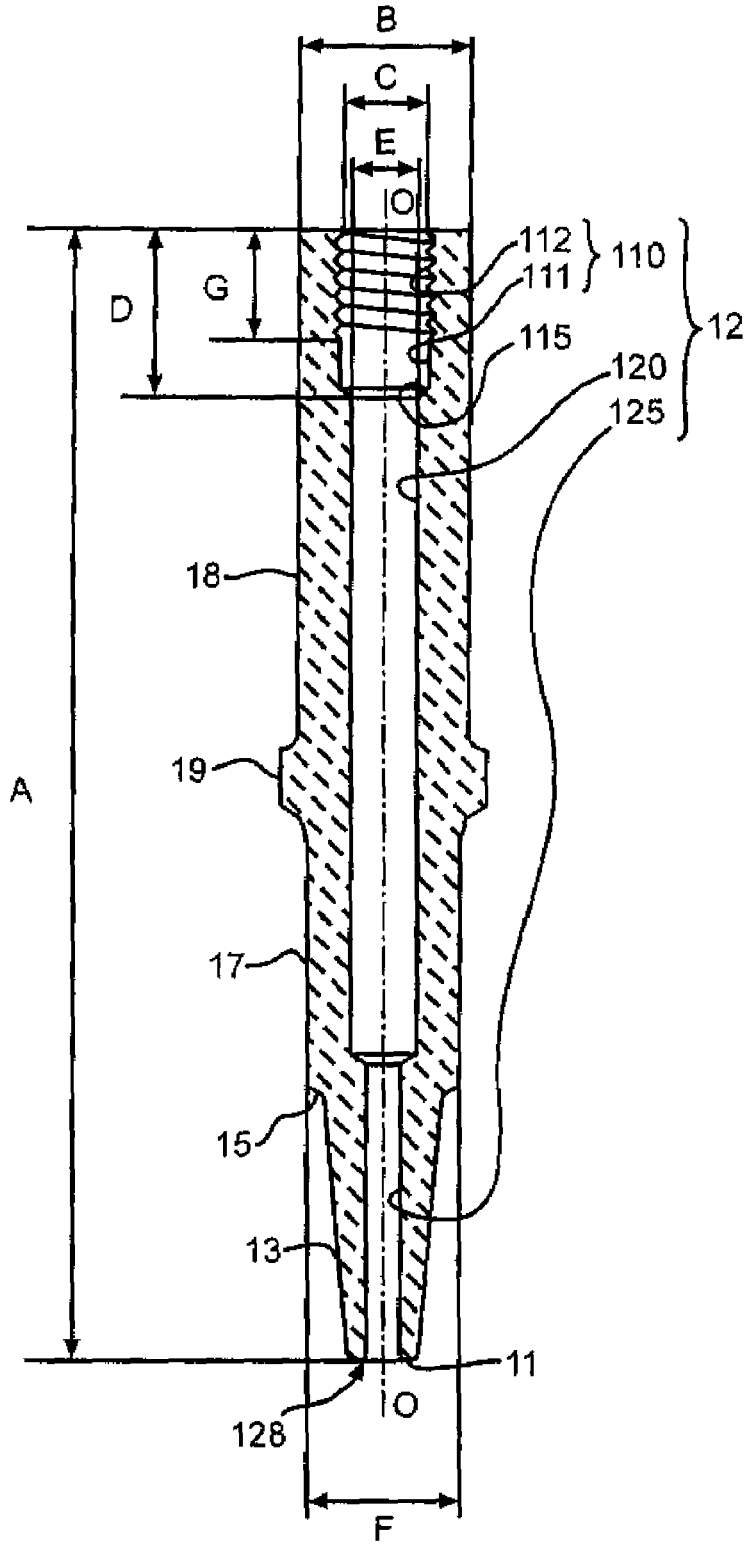
FIG. 2 is a full sectional view of an insulator of the spark plug of FIG. 1.

An embodiment of a spark plug according to the present invention will next be described in detail with reference to the drawings. FIG. 1 shows, in half section, the spark plug 100. FIG. 2 shows, in full section, an insulator 10. In FIG. 1, the direction of an axis O of the spark plug 100 is referred to as the vertical direction. In the following description, the lower end of the spark plug 100 in FIG. 1 is referred to as the front end of the spark plug 100, and the upper end is referred to as the rear end.

As shown in FIG. 1, the spark plug 100 includes the insulator 10, a metallic shell 50 which holds the insulator 10, a center electrode 20 held in an axial hole or bore 12 of the insulator 10, a ground electrode 30 whose one end is joined to the metallic shell 50 and whose distal end portion 31 faces a front end portion 22 of the center electrode 20, and an electrical terminal 40 which is electrically connected to the center electrode 20 is located at the rear end of the insulator 10.

First, the insulator 10 of the spark plug 100 will be described. As well known, the insulator 10 is a tubular, electrically insulative member formed by firing alumina or the like and having an axial hole or bore 12 extending in the direction of the axis O. As shown in FIG. 2, a flange portion 19 having the maximum outside diameter is formed at approximately the axial center, and a rear trunk portion 18 is formed rearward of the flange portion 19. A front trunk portion 17 is formed frontward of the flange portion 19, and a leg portion 13 is formed frontward of the front trunk portion 17. An outside diameter F of the front trunk portion 17 is smaller than an outside diameter B of the rear trunk portion 18. The leg portion 13 extending frontward from the front trunk portion 17 is smaller in outside diameter than the front trunk portion 17. The outside diameter of the leg portion 13 is reduced toward the front. By virtue of this, the clearance between the inner circumference of the metallic shell 50, which will be described later, and the outer circumference of the leg portion 13 increases toward the front, thereby preventing the occurrence of lateral sparks.

In order to impart a sufficient wall thickness (thickness of tubular wall) to the leg portion 13, whose outside diameter is reduced as mentioned above, a very small diameter portion 125 of the axial hole or bore 12 corresponding to the leg portion 13 of the insulator 10 has the smallest diameter as shown in FIG. 2. A small diameter portion 120 of the axial bore 12 extends rearward from the very small diameter portion 125, through the front trunk portion 17 and through the flange portion 19, up to the vicinity of the rear end of the rear trunk portion 18 while having a diameter E.

A portion of the axial bore 12 of the insulator 10 which extends frontward a length D from an opening 129 located at the rear end thereof is formed into a large diameter portion 110 which has a diameter C greater than the diameter E of the small diameter portion 120. The large diameter portion 110 has an internal thread portion 112 which extends frontward a length G from the opening 129. The internal-thread portion 112 is used to remove, from a green compact 250 (a prototype of the insulator 10), a press pin 150 (see FIG. 3) which is used to form the axial hole or bore 12 (a through-hole 251 of the green compact 250) in the process of manufacturing the insulator 10, which process will be described later. In the present embodiment, the minimum diameter of the internal thread portion 112 (diameter of an imaginary, cylindrical surface defined by crests of formed threads) is equal to the diameter of a smooth surface portion 111 of the large diameter portion 110 where no threads are formed.

The axial hole or bore 12 has a tapering, stepped portion 115 formed between the large diameter portion 110 and the small diameter portion 120. This stepped portion 115 facilitates injection of a sealing material 4 (generally, a sealing glass powder; see FIG. 1), which will be described later, in the process of manufacturing the spark plug 100. The stepped portion 115 is inclined about 60 degrees to a plane perpendicular to the axis O. An inclination of the stepped portion 115 less than 20 degrees may cause a failure in smooth injection of the sealing material 4. An inclination of the stepped portion 115 in excess of 80 degrees elongates the taper of the stepped portion 115 and may cause a designer to take trouble with adjusting dimensions of a support pin 200, which will be described later. In the present embodiment, the length D of the large diameter portion 110 does not encompass the stepped portion 115.

Although not illustrated, in some cases, a diameter increased portion whose diameter is increased in a stepped or tapered fashion from the diameter of the large diameter portion 110 of the axial bore 12 may be formed at a dihedral angle portion (corner portion) defined by the rear end face of the insulator 10 and the cylindrical wall surface of the axial bore 12. The process of manufacturing the insulator 10 involves the steps of glazing the rear trunk portion 18 and glost firing. Such a diameter increased portion serves as a glaze receiver for preventing the glaze from remaining in a mound form on the rear end face of the insulator 10 after glaze firing. In the present embodiment, the opening 129 serves as an opening of the axial bore 12 at the rear end face of the insulator 10, and the large diameter portion 110 includes such a glaze receiver, if any.

Next, the center electrode 20 will be described. The center electrode 20 shown in FIG. 1 is a rodlike electrode configured as follows: a core material 23 formed of copper, a copper alloy, or the like for accelerating heat release, is axially embedded in a central portion of an electrode base metal of a nickel alloy, such as INCONEL® 600 or 601. INCONEL is a registered trademark of Huntington Alloys Corp., of Huntington, W. Va. The center electrode 20 is held in a portion of the axial bore 12 which corresponds to the leg portion 13 of the insulator 10, while the front end portion 22 thereof projects from the front end face 11 of the insulator 10. The center electrode 20 is electrically connected, via the sealing material 4 and a resistor 3 provided within the axial hole or bore 12, to the electrical terminal 40 held in a portion of the axial bore 12 which corresponds to the rear trunk portion 18. A rear end portion 41 of the electrical terminal 40 projects from the rear end of the insulator 10. A high-voltage cable (not shown) is connected to the rear end portion 41 via a plug cap (not shown) to apply high voltage to the electrical terminal 40.

Next, the metallic shell 50 will be described. The metallic shell 50 holds the insulator 10 and fixes the spark plug 100 to an internal combustion engine (not illustrated). The metallic shell 50 holds the insulator 10 while surrounding a portion of the rear trunk portion 18 in the vicinity of the flange portion 19, the front trunk portion 17, and the leg portion 13. The metallic shell 50 is formed from low-carbon steel and includes tool engagement flats 51 which may be engaged by a spark plug wrench (not illustrated) and an external threaded portion 52 which is screwed into an engine head provided at an upper portion of the internal combustion engine.

Ring members 6 and 7 intervene between the tool engagement flats 51 of the metallic shell 50 and the rear trunk portion 18 of the insulator 10, and a talc 9 in powder form fills a clearance between the ring members 6 and 7. A crimp portion 53 is provided at the rear end of the tool engagement flats 51. Crimping the crimp portion 53 causes the insulator 10 to be pressed toward the front within the metallic shell 50 via the ring members 6 and 7 and the talc 9. As a result, a stepped portion 15 of the insulator 10 between the front trunk portion 17 and the leg portion 13 is supported, via a sheet packing 80, on a stepped portion 56 formed along the inner circumference of the metallic shell 50. The metallic shell 50 and the insulator 10 are thus united together. The sheet packing 80 tightly seals the metallic shell 50 and the insulator 10 against each other, thereby preventing outflow of combustion gas. The metallic shell 50 has a flange portion 54 formed at an axially central portion thereof. A gasket 5 is fitted to a threaded neck portion 55 between the flange portion 54 and the external thread portion 52, thereby preventing leakage of gas from a combustion chamber (not illustrated).

Next, the ground electrode 30 will be described. The ground electrode 30 is formed from a metal having high corrosion resistance; for example, an Ni alloy, such as INCONEL® 600 or 601. The ground electrode 30 has an approximately rectangular cross section perpendicular to the longitudinal direction thereof and assumes the form of a bent rectangular bar. A proximal end portion 32 of the ground electrode 30 is welded to a front end face 57 of the metallic shell 50. The distal end portion 31 of the ground electrode 30 located on a side opposite the proximal end portion 32 is bent so as to face the front end portion 22 of the center electrode 20. Noble metal chips 91 are welded in a standing condition to the front end portion 22 of the center electrode 20 and the distal end portion 31 of the ground electrode 30, respectively, in such a manner as to face each other, thereby forming a discharge gap therebetween.

Figure 3:
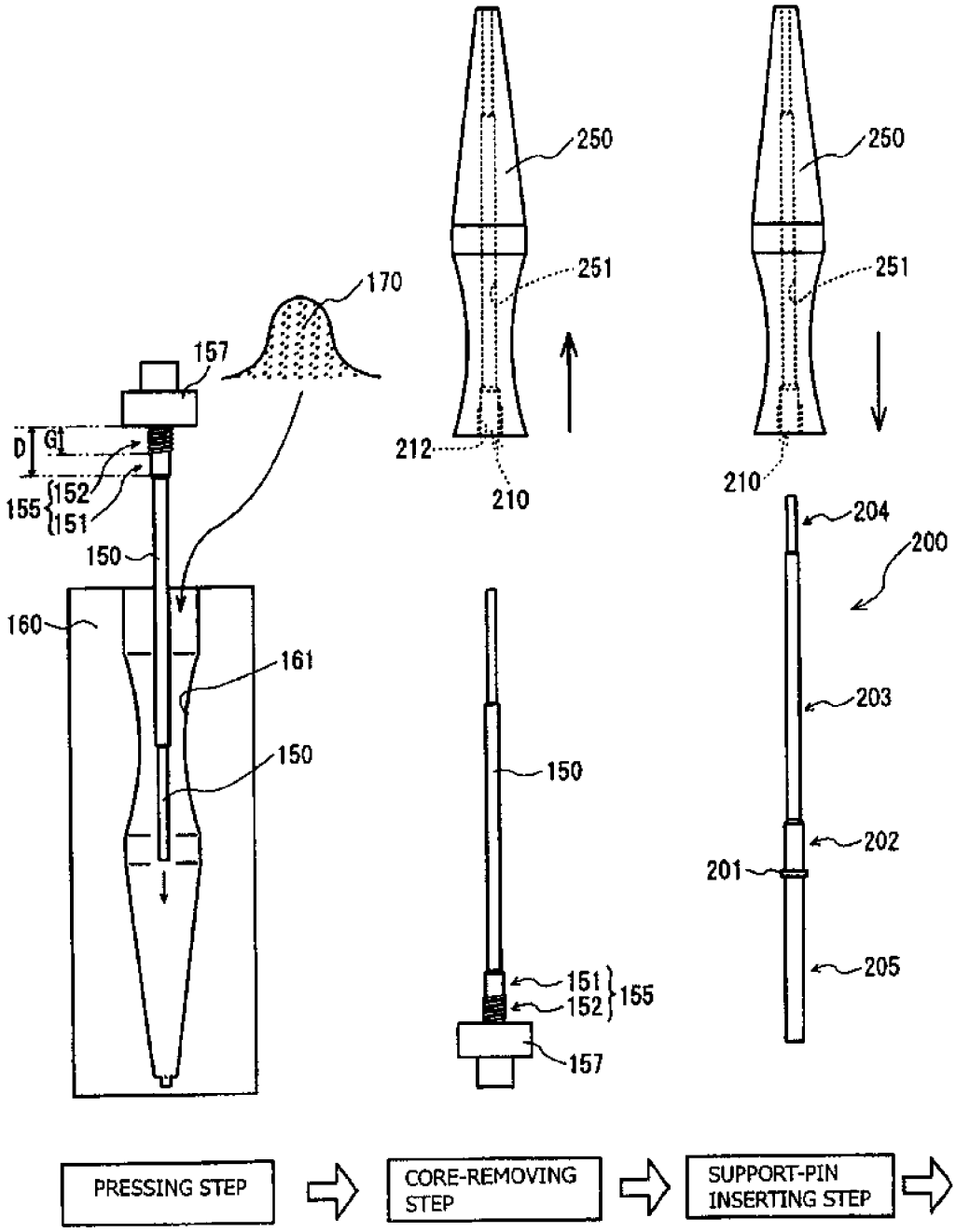
FIG. 3 is a schematic view showing a step of manufacturing the insulator of FIG. 2.
Figure 4:
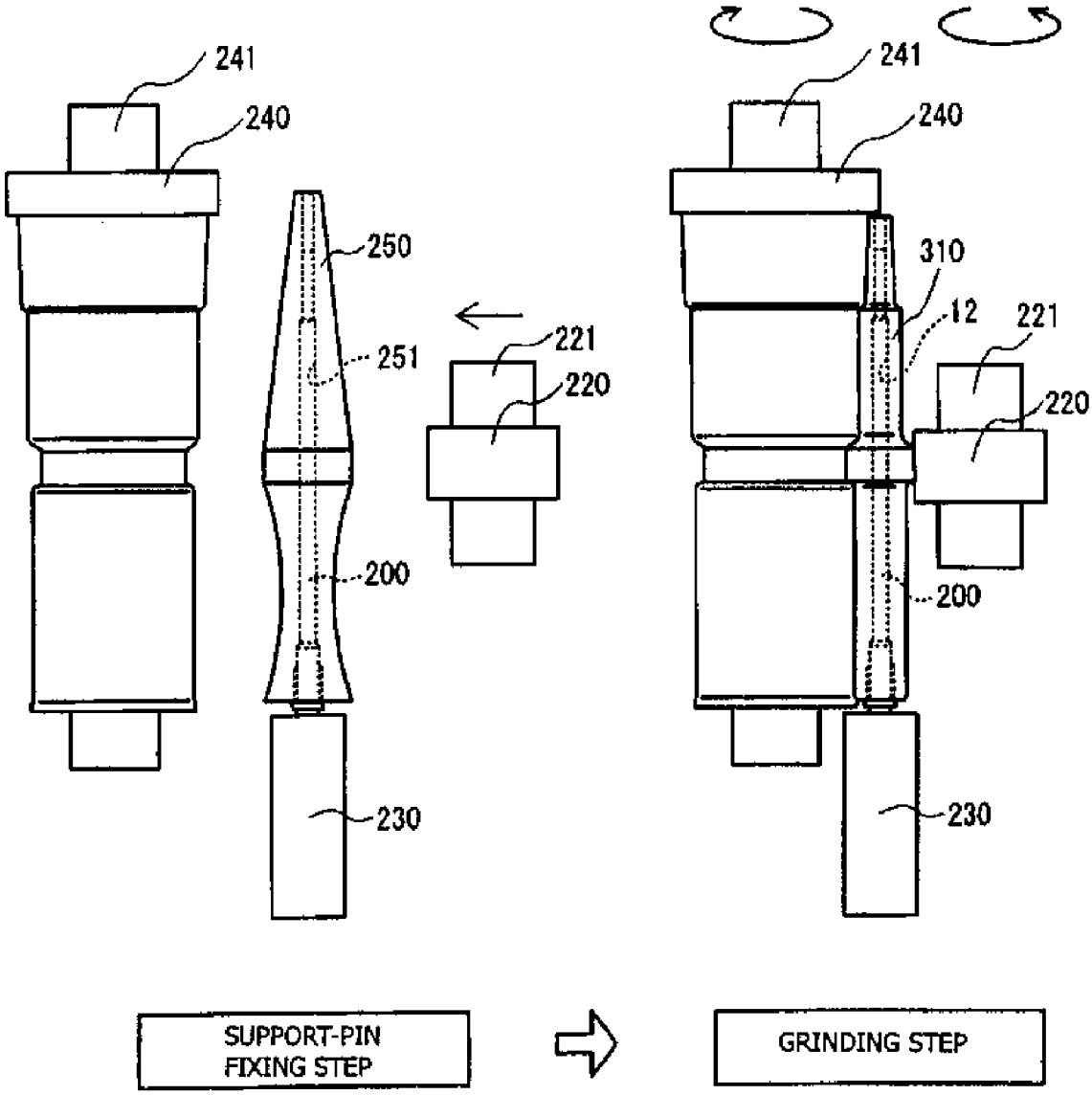
FIG. 4 is a schematic view showing a step of manufacturing the insulator of FIG. 2.

The insulator 10 of the spark plug 100 is manufactured as illustrated in FIGS. 3 and 4. FIGS. 3 and 4 schematically show manufacturing steps for the insulator 10.

As shown in FIG. 3, in the process of manufacturing the insulator 10, a first pressing step is performed by use of a rubber press to form a green compact 250, which is a prototype of the insulator 10. This pressing step is performed as follows. A molding material 170 is injected into a cavity 161 of a rubber mold 160. The press pin 150 is inserted into the molding material 170 along an axis corresponding to the axis of the green compact 250 to be formed. The press pin 150 is used to form a through hole 251 of the green compact 250 which is to become the axial hole or bore 12. The press pin 150 has a flange portion 157 for sealing the cavity 161 at the rear end with respect to the direction of insertion thereof. The press pin 150 has a large diameter portion 155 continuous with the flange portion 157. The large diameter portion 155 consists of a large diameter portion 151 for forming the smooth surface portion 111 of the large diameter portion 110 of the axial bore 12 of the insulator 10 and an external thread portion 152 for forming the internal-thread portion 112 of the large diameter portion 110. While the cavity 161 is sealed by the flange portion 157 of the press pin 150, the side wall of the rubber mold 160 is pressed inward, thereby compressing the molding material 170 contained in the cavity 161. Thus is formed the green compact 250 united with the press pin 150.

Next, the green compact 250 united with the press pin 150 is separated from the rubber mold 160. The press pin 150 is rotated about the axis thereof, thereby disengaging an internal thread portion 212 of a large diameter portion 210 of the through hole 251 of the green compact 250 and the external thread portion 152 of the large diameter portion 155 of the press pin 150 from each other. This disengages the green compact 250 and the press pin 150 from each other, whereby the green compact 250 can be removed from the press pin 150 in a core-removing step. Thus, the through hole 251 whose shape coincides with the profile of the press pin 150 is formed in the green compact 250 along the axis of the green compact 250.

In the next step, the support pin 200 is inserted into the through hole 251 of the green compact 250 in a support pin inserting step. The support pin 200 is a rodlike pin whose diameter is reduced from one end to the other end and is formed, by cutting, from cemented carbide. The support pin 200 has, from one end to the other end, a large diameter grip portion 205, a flange portion 201 which serves as a stopper when inserted into the green compact 250, a basal portion 202 having a large diameter similar to that of the grip portion 205, a trunk portion 203 smaller in diameter than the basal portion 202 and a distal end portion 204 smaller in diameter than the trunk portion 203. The support pin 200 is inserted from its distal end portion 204 into the through hole 251 of the green compact 250 from the large diameter portion 210 of the through hole 251. The distal end portion 204 of the support pin 200 abuts a portion of the through hole 251 which corresponds to the very small diameter portion 125 of the axial bore 12; the trunk portion 203 of the support pin 200 abuts a portion of the through hole 251 which corresponds to the small diameter portion 120 of the axial bore 12; the basal portion 202 of the support pin 200 abuts a portion of the through-hole 251 which corresponds to the large diameter portion 110 of the axial bore 12; and the flange portion 201 of the support pin 200 abuts the proximal end of the green compact 250 which corresponds to the rear end of the insulator 10 at which the opening 129 opens. In this manner, the green compact 250 and the support pin 200 are positioned in relation to each other. The flange portion 201 is not necessarily formed from the same material as that of the trunk portion 203. For example, the flange portion 201 may assume the form of a separate stopper formed from silicone rubber.

As shown in FIG. 4, the grip portion 205 of the support pin 200 is chucked by a chuck 230 in a support pin fixing step. While the green compact 250 is sandwiched between a grindstone 240, which rotates about a shaft 241, and a regulating wheel 220, which rotates about a shaft 221, the outer surface of the green compact 250 is ground in a grinding step. The shaft 241 of the grindstone 240 and the shaft 221 of the regulating wheel 220 are provided in parallel; the grindstone 240 and the regulating wheel 220 are rotated in opposite directions; and the grindstone 240 is rotated at an angular velocity faster than that of the regulating wheel 220. The surface of the regulating wheel 220 has a gripping force and abuts a portion of the green compact 250 which is to become the flange portion 19 of the insulator 10 after grinding, thereby pressing the green compact 250 toward the grindstone 240 and preventing the green compact 250 from being rotatively dragged by the rotating grindstone 240 for efficient grinding.

Through the above steps, the outer surface of the green compact 250 is ground; i.e., the green compact 250 is ground into a preform 310 having the profile of the insulator 10. The preform 310 undergoes firing, marking, glazing, glost firing, etc., to thereby be formed into the insulator 10 in a firing step (not illustrated).

In the above-mentioned process of manufacturing the insulator 10, in the course of grinding the green compact 250, the support pin 200 which supports the green compact 250 is fixed at its grip portion 205 with its distal end portion 204 being free. In this condition, the green compact 250 is ground by the grindstone 240 which abuts the green compact 250 from the direction perpendicular to the axial direction of the support pin 200. Thus, the support pin 200 is subjected to stress which is generated in association with such application of the grindstone 240. Since the grip portion 205 of the support pin 200 is fixed, stress tends to concentrate on the basal portion 202, thus raising the risk of deflection of the support pin 200. In order to reduce deflection of the support pin 200, the present embodiment imparts a large diameter to the basal portion 202 of the support pin 200. However, merely imparting a large diameter to the basal portion 202 of the support pin 200 requires increasing the outside diameter B (see FIG. 2) of the rear trunk portion 18 in order to obtain a sufficient thickness of the insulator 10. This causes difficulty in reducing the size of the insulator 10 as well as the size of the spark plug 100. In order to cope with this problem, the present embodiment specifies dimensions of the completed insulator 10 so as to impart a sufficient diameter and length to the basal portion 202 of the support pin 200 for use in manufacturing the insulator 10.

Specifying dimensions of the insulator 10 will be described with reference to FIGS. 2 and 3. Dimensions of the insulator 10 to be discussed below are of a product insulator.

The insulator 10 of the present embodiment shown in FIG. 2 has an overall length A (along the axis O) of 65 mm or more and a diameter E of the small diameter portion 120 of 3.4 mm or less. The present invention intends to solve problems which arise in the insulator in association with a reduction in the size of the spark plug, and thus is not applied to insulators having an overall length A of 100 mm or more. Similarly, the present invention is not applied to insulators in which the diameter E of the small diameter portion of the axial hole is 3.4 mm or more, since these insulators are consequentially increased in the outside diameter B of their rear trunk portions in order to obtain a sufficient wall thickness, and thus reducing the size thereof becomes difficult.

As mentioned above, in the process of manufacturing the insulator 10, the green compact 250, which is a prototype of the insulator 10, is supported by the support pin 200. As compared with a case of manufacturing an insulator having an overall length A of 65 mm or more, in the case of manufacturing an insulator having an overall length A of less than 65 mm, the barycenter of the green compact 250 is biased more toward a root of the support pin 200 (toward the grip portion 205 located at the lower side of FIG. 4), and thus the support pin 200 is unlikely to deflect by nature. In the process of manufacturing the insulator 10, the grip portion 205 of the support pin 200 is fixed on a manufacturing apparatus; therefore, the boundary between the basal portion 202 and the flange portion 201, which is the boundary between a fixed portion and an unfixed portion of the support pin 200, corresponds to the above-mentioned root of the support pin 200.

For this reason, for the insulator 10 whose overall length A (length along the axis O) is 65 mm or more and whose small diameter portion 120 of the axial bore 12 has a diameter E of 3.4 mm or less, the present embodiment further specifies dimensions as mentioned below.

First, for the completed insulator 10, the present embodiment specifies that the ratio of the diameter C of the large diameter portion 110 to the diameter E of the small diameter portion 120 is 1.16 or more. In the process of manufacturing the insulator 10, a grindstone is applied to the green compact 250 attached to the support pin 200, from a direction perpendicular to the axis of the support pin 200, thereby grinding the green compact 250. Since the support pin 200 is fixed at its grip portion 205 as mentioned above, stress induced in the support pin 200 by grinding force which the grindstone imposes on the green compact 250 increases toward the grip portion 205 and tends to concentrate particularly on the root or its vicinity of the support pin 200. If the basal portion 202 has a diameter equal to that of the trunk portion 203 which corresponds to a diameter E of the small diameter portion 120 of the axial bore 12 of 3.4 mm or less, the basal portion 202 may fail to endure concentrated stress. In order to cope with this problem, the present embodiment specifies dimensions of the support pin 200 by means of specifying dimensions of the completed insulator 10 as mentioned above so as to make the basal portion 202 of the support pin 200 greater in diameter than the trunk portion 203.

In order to impart rigidity to the insulator 10, while providing a required length along the axis O to the large diameter portion 110 of the axial hole or bore 12, a portion of the insulator 10 having a desired wall thickness (a portion of the insulator 10 corresponding to the small diameter portion 120 of the axial bore 12) is desirably elongated to the greatest possible extent. To this end, the present embodiment specifies that the ratio of the axial length D of the large diameter portion 110 of the axial bore 12 to the overall length A of the insulator 10 is 0.09 or more.

If the manufactured spark plug 100 must be handled excessively carefully because a portion of the insulator corresponding to the large diameter portion 110 of the axial bore 12 has an excessively small wall thickness, the spark plug 100 is not feasible for use. Also, it is not desirable that dielectric breakdown occurs during use of the spark plug 100 because of the wall thickness of the insulator being excessively small. In other words, the insulator 10 must be excellent mechanically and electrically. In order to impart a sufficient wall thickness to a portion of the insulator 10 corresponding to the large diameter portion 110 of the axial bore 12 while imparting a sufficient diameter to the basal portion 202 of the support pin 200, the present embodiment specifies that the ratio of the diameter C of the large diameter portion 110 of the axial bore 12 to the outside diameter B of the rear trunk portion 18 is 0.47 or less.

Designing the insulator 10 which satisfies the above-mentioned dimensional requirements also specifies dimensions for the support pin 200 for use in manufacturing this insulator 10. The support pin 200 having the specified dimensions has high rigidity and is thus reduced in deflection. The insulator 10 manufactured by use of this support pin 200 is unlikely to suffer occurrence of eccentricity of the axial bore 12.

Next, eccentricity of the axial bore 12 will be described. As mentioned above, in grinding the green compact 250, which is a prototype of the insulator 10, stress concentrates at or proximate the root of the support pin 200. Thus, if the support pin 200 does not have sufficiently high rigidity, the support pin 200 is likely to deflect; i.e., the position of the axis of the support pin 200 as observed at the distal end portion 204 is likely to deviate from the original position of the axis (the position of the axis when the support pin 200 is not deflected). If the green compact 250 is ground with the support pin 200 in a deflected condition, the position of the axis of the axial bore 12 of the completed insulator 10 deviates from the position of the axis of this insulator 10. This eccentricity of the axial bore 12 increases toward the front end of the insulator 10. A specific degree of eccentricity may be measured as follows. The front end face 11 of the insulator 10 is projected on a plane perpendicular to the axis O. On the plane, the distance between the center of a projected outer circumference of the front end face 11 (i.e., the center of a projected outer circumference of the leg portion 13) and the center of a projected inner circumference of the front end face 11 (i.e., the center of the projected opening 128 of the axial bore 12 (see FIG. 2)) is measured (the thus-measured degree of eccentricity of the axial bore is hereinafter referred to as the "amount of unevenness in wall thickness"). The amount of unevenness in wall thickness numerically represents the degree of deflection of the support pin 200 in the process of manufacturing the insulator 10.

The present invention specifies that the amount of unevenness in wall thickness of the insulator 10 is less than 0.07 mm, so as to suppress eccentricity of the axial bore 12. It has been confirmed from evaluation tests, which will be described later, that the spark plug 100 using the insulator 10 whose amount of unevenness in wall thickness is less than 0.07 mm is free from occurrence of lateral sparks.

When the insulator 10 is to be newly designed for suppressing eccentricity of the axial bore 12 in order to manufacture the spark plug 100 which is free from occurrence of lateral sparks, there are many combinations of dimensions for the insulator 10 which satisfies the above-mentioned dimensional requirements. The inventors of the present invention have statistically analyzed dimensions of those insulator samples in which eccentricity of the axial bore 12 could be suppressed. As a result, the inventors have found that application of the analytic findings to the design of insulators facilitates manufacture of those insulators which satisfy the above-mentioned dimensional requirements.

Specifically, the present embodiment specifies that the amount of unevenness in wall thickness estimated through calculation by the following expression which is induced by known multiple regression analysis and is less than 0.07.

$$0.01(17.527+0.141A-0.285B-6.124C-0.14D+1.105E) \quad (1).$$

The expression (1) is applied to the insulator 10 which has an overall length A of 65 mm or more and a diameter E of the small diameter portion 120 of the axial bore 12 of 3.4 mm or less.

The expression (1) is obtained by use of software JUSE-Stat Works (Trademark of a product from The Institute of Japanese Union of Scientists & Engineers). Specifically, on the basis of the results of evaluation tests, which will be described later, the relation between the amount of unevenness in wall thickness and dimensions A, B, C, D, and E of insulator samples was statistically analyzed by use of the above-mentioned software, thereby inducing the expression (1). A to E in the expression (1) are variables. An insulator is designed such that the amount of unevenness in wall thickness estimated through calculation by substituting values A to E into the expression (1) is less than 0.07. A support pin for use in manufacturing the thus designed insulator is reduced in deflection. A spark plug which is manufactured by use of the thus manufactured insulator is free from occurrence of lateral sparks. Since the amount of unevenness in wall thickness to be estimated is small, the values used in the process of calculation are 100 fold values. Finally, a value obtained by calculation is multiplied by 0.01 for decimal adjustment.

It has been confirmed from the following evaluation tests that the spark plug 100 manufactured by use of the insulator 10 whose amount of unevenness in wall thickness is made less than 0.07 mm by suppressing eccentricity of the axial bore 12 through satisfaction of the above-mentioned dimensional requirements can be free from occurrence of lateral sparks.

EXAMPLE 1

In this evaluation test, 40 kinds of insulator samples were manufactured in such a manner that the overall length A (mm), the length D (mm) of the large diameter portion of the axial bore, the outside diameter B (mm) of the rear trunk portion, the diameter C (mm) of the large diameter portion of the axial the length D (mm) of the large diameter portion of the axial bore, and the diameter E (mm) of the small diameter portion of the axial bore are selected from among respectively predetermined several values. In order to compare those samples which have dimensions of A to E in a predetermined combination, the samples are grouped into 12 Groups R1 to R12. For insulator samples in Groups R1 to R12, the dimensions A to E are specified as follows.

Group R1 has Samples 1 and 2 which have an overall length A of 80 mm, an outside diameter B of the rear trunk portion of 7.2 mm, a diameter C of the large diameter portion of an axial bore of 2.8 mm, a length D of the large diameter portion of 31.0 mm and 37.0 mm, respectively, and a diameter E of the small diameter portion of the axial bore of 2.2 mm and 2.0 mm, respectively, for comparison of the amount of unevenness in wall thickness therebetween. Group R2 has Samples 3 and 4 which are similar to Samples 1 and 2 of Group R1 except that the overall length A is 65 mm and that the length D of the large diameter portion of the axial bore is 18.5 mm and 25.0 mm, respectively, for comparison of the amount of unevenness in wall thickness therebetween.

Group R3 has Samples 5 to 8 which have an overall length A of 80 mm, an outside diameter B of the rear trunk portion of 7.5 mm, a diameter C of the large diameter portion of the axial bore of 3.0 mm, a diameter E of the small diameter portion of the axial bore of 2.5 mm, and a length D of the large diameter portion of 18.5 mm, 25.0 mm, 31.0 mm, and 37.0 mm, respectively, for comparison of the amount of unevenness in wail thickness thereamong. Group R4 has Samples 9 to 12 which are similar to Samples 5 to 8, respectively, of Group R3 except that the outside diameter B of the rear trunk portion is 9.0 mm, for comparison of the amount of unevenness in wall thickness thereamong.

Group R5 has Samples 13 to 16 which have an overall length A of 65 mm, an outside diameter B of the rear trunk portion of 7.5 mm, a diameter C of the large diameter portion of the axial bore of 3.0 mm, a diameter E of the small diameter portion of the axial bore of 2.5 mm, and a length D of the large diameter portion of 11.0 mm, 15.0 mm, 18.5 mm, and 25.0 mm, respectively, for comparison of the amount of unevenness in wall thickness thereamong. Group R6 has Samples 17 to 20 which are similar to Samples 13 to 16, respectively, of Group R5 except that the outside diameter B of the rear trunk portion is 9.0 mm, for comparison of the amount of unevenness in wall thickness thereamong.

Group R7 has Samples 21 to 24 which have an overall length A of 80 mm, an outside diameter B of the rear trunk portion of 7.5 mm, a diameter C of the large diameter portion of the axial bore of 3.5 mm, a diameter E of the small diameter portion of the axial bore of 3.0 mm, and a length D of the large diameter portion of 11.0 mm, 18.5 mm, 25.0 mm, and 37.0 mm, respectively, for comparison of the amount of unevenness in wall thickness thereamong. Group R8 has Samples 25 to 28 which are similar to Samples 21 to 24, respectively, of Group R7 except that the outside diameter B of the rear trunk portion is 9.0 mm, for comparison of the amount of unevenness in wall thickness thereamong.

Group R9 has Samples 29 to 32 which have an overall length A of 65 mm, an outside diameter B of the rear trunk portion of 7.5 mm, a diameter C of the large diameter portion of the axial bore of 3.5 mm, a diameter E of the small diameter portion of the axial bore of 3.0 mm, and a length D of the large diameter portion of 6.0 mm, 11.0 mm, 18.5 mm, and 25.0 mm, respectively, for comparison of the amount of unevenness in wall thickness thereamong. Group R10 has Samples 33 to 36 which are similar to Samples 29 to 32, respectively, of Group R9 except that the outside diameter B of the rear trunk portion is 9.0 mm, for comparison of the amount of unevenness in wall thickness thereamong.

Group R11 has Samples 37 and 38 which have an overall length A of 80 mm, an outside diameter B of the rear trunk portion of 9.0 mm, a diameter C of the large diameter portion of the axial bore of 4.0 mm, a diameter E of the small diameter portion of the axial bore of 3.4 mm, and a length D of the large diameter portion of 6.0 mm and 11.0 mm, respectively, for comparison of the amount of unevenness in wall thickness therebetween. Group R12 has Samples 39 and 40 which are similar to Samples 37 and 38, respectively, of Group R11 except that the overall length A is 65 mm, for comparison of the amount of unevenness in wall thickness therebetween.

Samples 1 to 40 are designed to satisfy the following dimensional requirements: the overall length A is 65 mm or more; the diameter E of the small diameter portion of the axial bore is 3.4 mm or less; the ratio of the diameter C of the large diameter portion of the axial bore to the diameter E of the small diameter portion is 1.16 or more; the ratio of the length D of the large diameter portion to the overall length A is 0.09 or more: and the ratio of the diameter C of the large diameter portion to the outside diameter B of the rear trunk portion is 0.47 or less.

Spark plugs were manufactured by use of the samples and were tested for occurrence of lateral sparks. The test for lateral sparks was conducted by the following method. The spark plugs manufactured by use of the samples were attached to a V-type, 4-cylinder, 4-cycle engine of a piston displacement of 800 cc. While the engine was idled at 1,500 rpm, discharge waveforms were observed. When discharge waveforms associated with 100 discharges included even a single waveform indicative of a lateral spark, the spark plug was evaluated as "×" indicative of presence of lateral sparks. When a waveform indicative of a lateral spark was not included, the spark plug was evaluated as "○" indicative of an absence of lateral sparks. Table 1 shows measurements of the amount of unevenness in wall thickness of the samples and presence/absence of lateral sparks in the spark plugs manufactured by use of the samples.

TABLE 1

| SAMPLE | A (mm) | D (mm) | B (mm) | C (mm) | E (mm) | AAA (mm) | GROUP | BBB | CCC | GROUP | DDD |
|---|---|---|---|---|---|---|---|---|---|---|---|
| 1 | 80 | 31.0 | 7.2 | 2.8 | 2.2 | 0.077 | R1 | x | 0.077 | S1 | 0.000 |
| 2 | 80 | 37.0 | 7.2 | 2.8 | 2.0 | 0.067 | | o | 0.066 | | −0.001 |
| 3 | 65 | 18.5 | 7.2 | 2.8 | 2.2 | 0.073 | R2 | x | 0.073 | S2 | 0.000 |
| 4 | 65 | 25.0 | 7.2 | 2.8 | 2.0 | 0.062 | | o | 0.062 | | 0.000 |
| 5 | 80 | 18.5 | 7.5 | 3.0 | 2.5 | 0.086 | R3 | x | 0.085 | S3 | −0.001 |
| 6 | 80 | 25.0 | 7.5 | 3.0 | 2.5 | 0.075 | | x | 0.076 | | 0.001 |
| 7 | 80 | 31.0 | 7.5 | 3.0 | 2.5 | 0.067 | | o | 0.067 | | 0.000 |
| 8 | 80 | 37.0 | 7.5 | 3.0 | 2.5 | 0.059 | | o | 0.059 | | 0.000 |
| 9 | 80 | 18.5 | 9.0 | 3.0 | 2.5 | 0.082 | R4 | x | 0.080 | S4 | −0.002 |
| 10 | 80 | 25.0 | 9.0 | 3.0 | 2.5 | 0.071 | | x | 0.071 | | 0.000 |
| 11 | 80 | 31.0 | 9.0 | 3.0 | 2.5 | 0.063 | | o | 0.063 | | 0.000 |
| 12 | 80 | 37.0 | 9.0 | 3.0 | 2.5 | 0.055 | | o | 0.055 | | 0.000 |
| 13 | 65 | 11.0 | 7.5 | 3.0 | 2.5 | 0.076 | R5 | x | 0.074 | S5 | −0.002 |
| 14 | 65 | 15.0 | 7.5 | 3.0 | 2.5 | 0.069 | | o | 0.068 | | −0.001 |
| 15 | 65 | 18.5 | 7.5 | 3.0 | 2.5 | 0.063 | | o | 0.064 | | 0.001 |
| 16 | 65 | 25.0 | 7.5 | 3.0 | 2.5 | 0.053 | | o | 0.054 | | 0.001 |
| 17 | 65 | 11.0 | 9.0 | 3.0 | 2.5 | 0.072 | R6 | x | 0.070 | S6 | −0.002 |
| 18 | 65 | 15.0 | 9.0 | 3.0 | 2.5 | 0.065 | | o | 0.064 | | −0.001 |
| 19 | 65 | 18.5 | 9.0 | 3.0 | 2.5 | 0.058 | | o | 0.059 | | 0.001 |
| 20 | 65 | 25.0 | 9.0 | 3.0 | 2.5 | 0.049 | | o | 0.050 | | 0.001 |
| 21 | 80 | 11.0 | 7.5 | 3.5 | 3.0 | 0.069 | R7 | o | 0.070 | S7 | 0.001 |
| 22 | 80 | 18.5 | 7.5 | 3.5 | 3.0 | 0.060 | | o | 0.060 | | 0.000 |
| 23 | 80 | 25.0 | 7.5 | 3.5 | 3.0 | 0.051 | | o | 0.051 | | 0.000 |
| 24 | 80 | 37.0 | 7.5 | 3.5 | 3.0 | 0.034 | | o | 0.034 | | 0.000 |
| 25 | 80 | 11.0 | 9.0 | 3.5 | 3.0 | 0.065 | R8 | o | 0.066 | S8 | 0.001 |
| 26 | 80 | 18.5 | 9.0 | 3.5 | 3.0 | 0.055 | | o | 0.055 | | 0.000 |
| 27 | 80 | 25.0 | 9.0 | 3.5 | 3.0 | 0.047 | | o | 0.046 | | −0.001 |
| 28 | 80 | 37.0 | 9.0 | 3.5 | 3.0 | 0.030 | | o | 0.029 | | −0.001 |
| 29 | 65 | 6.0 | 7.5 | 3.5 | 3.0 | 0.056 | R9 | o | 0.056 | S9 | 0.000 |
| 30 | 65 | 11.0 | 7.5 | 3.5 | 3.0 | 0.049 | | o | 0.049 | | 0.000 |
| 31 | 65 | 18.5 | 7.5 | 3.5 | 3.0 | 0.039 | | o | 0.038 | | −0.001 |
| 32 | 65 | 25.0 | 7.5 | 3.5 | 3.0 | 0.031 | | o | 0.029 | | −0.002 |
| 33 | 65 | 6.0 | 9.0 | 3.5 | 3.0 | 0.052 | R10 | o | 0.052 | S10 | 0.000 |
| 34 | 65 | 11.0 | 9.0 | 3.5 | 3.0 | 0.044 | | o | 0.045 | | 0.001 |
| 35 | 65 | 18.5 | 9.0 | 3.5 | 3.0 | 0.034 | | o | 0.034 | | 0.001 |
| 36 | 65 | 25.0 | 9.0 | 3.5 | 3.0 | 0.026 | | o | 0.025 | | −0.001 |
| 37 | 80 | 6.0 | 9.0 | 4.0 | 3.4 | 0.046 | R11 | o | 0.047 | S11 | 0.001 |
| 38 | 80 | 11.0 | 9.0 | 4.0 | 3.4 | 0.041 | | o | 0.040 | | −0.001 |
| 39 | 65 | 6.0 | 9.0 | 4.0 | 3.4 | 0.026 | R12 | o | 0.025 | S12 | −0.001 |
| 40 | 65 | 11.0 | 9.0 | 4.0 | 3.4 | 0.016 | | o | 0.018 | | 0.000 |

Note:
AAA: amount of unevenness in wall thickness;
BBB: absence/presence of lateral sparks;
CCC: amount of unevenness in wall thickness estimated by multiple regression analysis;
DDD: difference between measured and estimated amounts of unevenness in wall thickness.

As shown in Table 1, Samples 1, 3, 5, 6, 9, 10, 13, and 17 exhibited an amount of unevenness in wall thickness of 0.07 mm or more. Spark plugs which were manufactured by use of these samples exhibited occurrence of lateral sparks. It was confirmed from this that a spark plug manufactured by use of an insulator whose amount of unevenness in wall thickness is made less than 0.07 mm by designing the insulator so as to satisfy the aforementioned dimensional requirements can be free from occurrence of lateral sparks.

Figure 5:
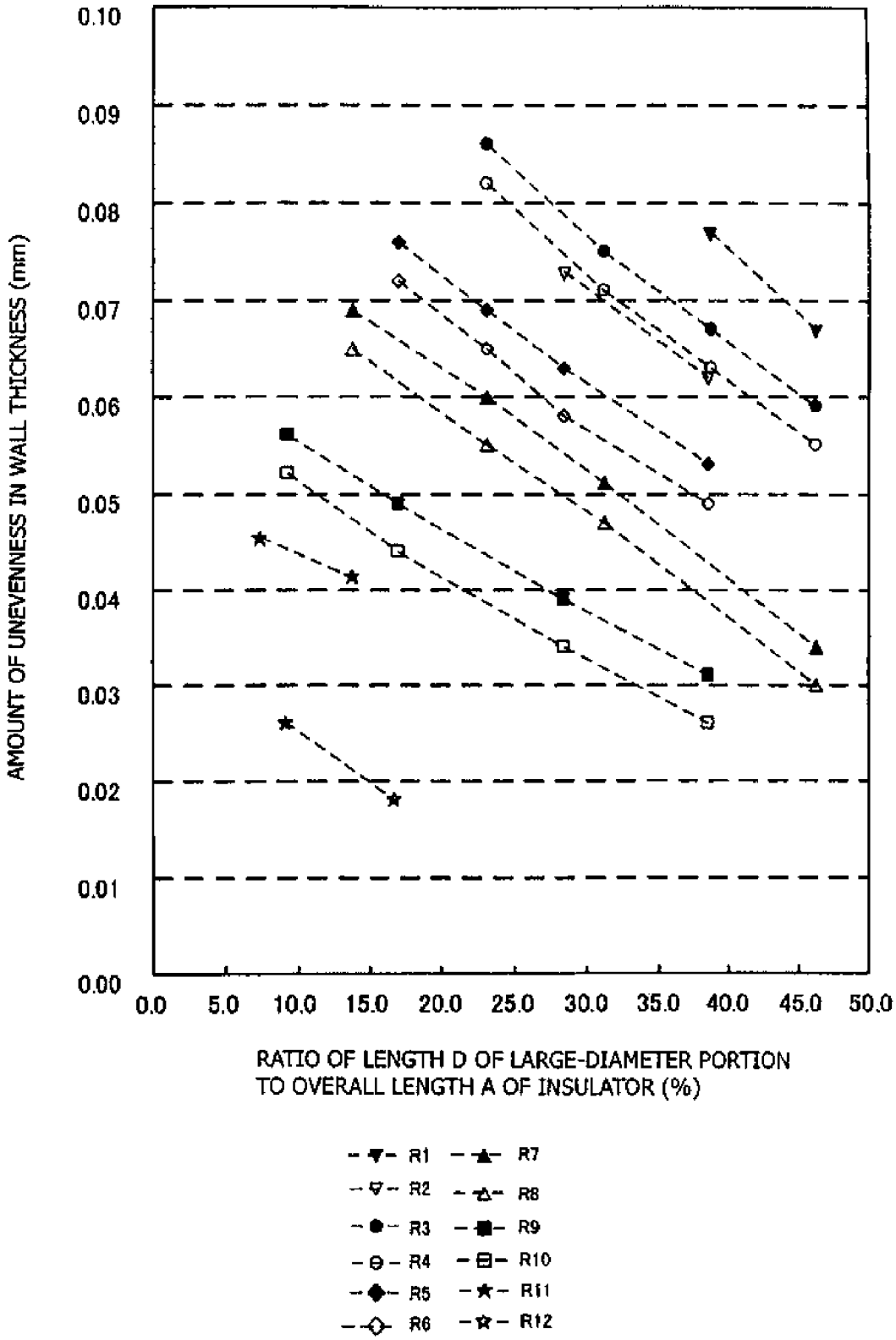
FIG. 5 is a graph of the amount of unevenness in wall thickness of an insulator vs. the ratio of the length D of a large diameter portion of an axial bore to the overall length A of the insulator, plotting measured amounts for insulators in groups.

FIG. 5 graphs the relationship, on a group basis, between the ratio of the length D of the large diameter portion of the axial bore to the overall length A of the insulator and a measured amount of unevenness in wall thickness. It is confirmed from this graph that, in all of Groups R1 to R12, as the ratio of the length D of the large diameter portion of the axial bore to the overall length A of the insulator decreases, the amount of unevenness in wall thickness increases. This is illustrated in the graph of FIG. 5 by all of the groups showing a downward tendency to the right. In other words, it is confirmed that as the ratio of the length of the basal portion of the support pin to the length of the support pin decreases, deflection of the support pin increases.

EXAMPLE 2

Figure 6:
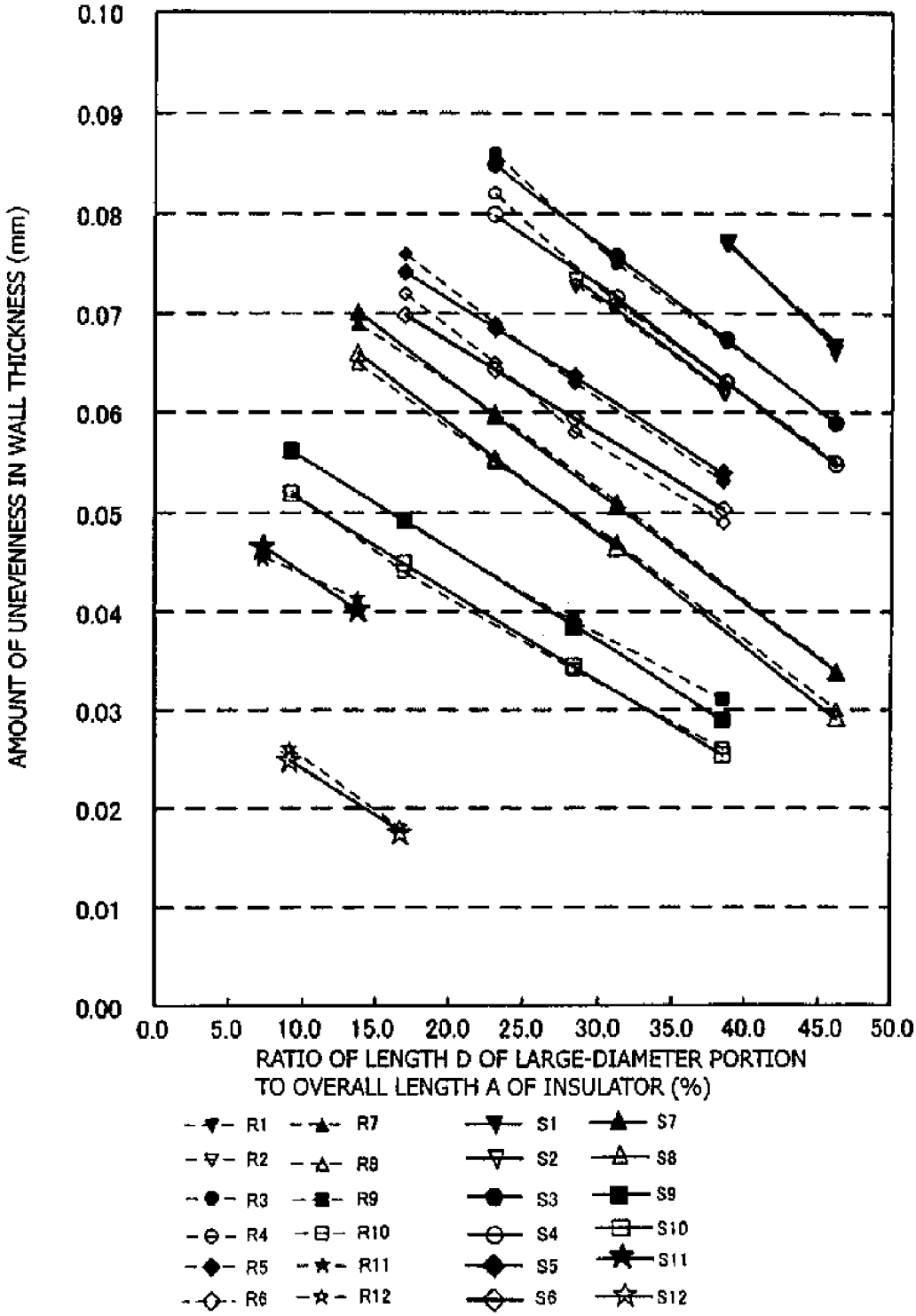
FIG. 6 is a graph of the amount of unevenness in wall thickness of an insulator vs. the ratio of the length D of a large diameter portion of an axial bore to the overall length A of the insulator, plotting measured amounts of FIG. 5 and estimated (calculated) amounts in a superposed representation for the insulators in groups.

The test results of Samples 1 to 40 were subjected to multiple regression analysis by use of the above-mentioned software while the dimensions A to E were used as parameters, whereby the above-mentioned expression (1) was induced. In order to verify the effectiveness of this expression, the amount of unevenness in wall thickness was estimated (calculated) for Samples 1 to 40 by use of the expression (1). The difference between measured and estimated amounts of unevenness in wall thickness was examined. The results of examination are additionally contained in Table 1. FIG. 6 shows a graph of the amount of unevenness in wall thickness of the insulator vs. the ratio of the length D of a large diameter portion of the axial bore to the overall length A of the insulator, plotting measured amounts of FIG. 5 and estimated (calculated) amounts in a superposed representation for Samples 1 to 40 which are grouped into Groups S1 to S12 corresponding to Groups R1 to R12.

As shown in Table 1, the difference between measured and estimated amounts of unevenness in wall thickness is within 0.002, indicating that the expression (1) is effective. It is confirmed from the graph of FIG. 6 that amounts of unevenness in wall thickness estimated through calculation by the expression (1) with the dimensions A to E of the insulator as parameters substantially coincide with corresponding measured amounts. That is, by designing the insulator such that the amount of unevenness in wall thickness thereof estimated through calculation by use of the expression (1) is less than 0.07, a spark plug manufactured by use of the insulator can be free from occurrence of lateral sparks.

The present invention is not limited to the above embodiment, but may be embodied in various other forms. For example, the embodiment is described while mentioning the large diameter portion 110 of the axial bore 12 having the internal thread portion 112 and the smooth surface portion 111. However, the large diameter portion 110 may have only the smooth-surface portion 111 without having the internal thread portion 112 (i.e., the length G is 0), or may have only the internal thread portion 112 without having the smooth surface portion 111 (i.e., the length G is equal to the length D).

According to the present embodiment, after the green compact is fitted to the support pin, the support pin is fixedly chucked at its grip portion by a chuck. However, the present invention is not limited to this working procedure. For example, the following working procedures may be employed. For continuous processing, a plurality of support pins are fixed on a work jig, and green compacts are fixedly fitted to the corresponding support pins. Alternatively, in order to improve handling (working efficiency), a preliminary firing step or the like may follow the rubber pressing step.

In the case of an insulator having corrugations, a rear trunk portion thereof means a portion on which its name is printed, and the outside diameter of the rear trunk portion may be designated as a mark diameter. An insulator of a completed spark plug has a glaze layer of borosilicate glass or the like. The thickness of the glaze layer is about 20 μm and is thus negligible as far as the outside diameter of a trunk portion of an insulator in the present invention is concerned.

A green compact in the present invention is not limited to a compacted form of material powder, but means a body before grinding. Similarly, a preform is not limited to a body immediately after grinding, but means a body before firing.

What is claimed is:

1. A spark plug comprising an insulator having a bore extending in an axial direction and holding a center electrode for generating spark discharge in a front end portion of the axial bore and a terminal electrically connected to the center electrode, at a rear end portion of the axial bore, wherein the axial bore of the insulator comprises a large diameter portion continuous with an opening located at a rear end of the axial bore and a small diameter portion continuous with a front end of the large diameter portion and smaller in diameter than the large diameter portion, and wherein an axial length A in mm of the insulator, an outside diameter B in mm of a rear trunk portion located rearward of a portion of the insulator having a maximum outside diameter, a diameter C in mm of the large diameter portion, an axial length D in mm of the large diameter portion, and a diameter E in mm of the small diameter portion satisfy the following inequalities:

$$A \geqq 80$$

$$E \leqq 3.4$$

$$0.01(17.527+0.141A-0.285B-6.124C-0.14D+1.105E)<0.07.$$

2. A spark plug comprising an insulator having a bore extending in an axial direction and holding a center electrode for generating spark discharge in a front end portion of the axial bore and a terminal electrically connected to the center electrode in a rear end portion of the axial bore, wherein the axial bore of the insulator comprises a large diameter portion continuous with an opening located at a rear end of the axial bore and a small diameter portion continuous with a front end of the large diameter portion and smaller in diameter than the large diameter portion, wherein an axial length A in mm of the insulator, an outside diameter B in mm of a rear trunk portion located rearward of a portion of the insulator having a maximum outside diameter, a diameter C in mm of the large diameter portion, an axial length D in mm of the large diameter portion, and a diameter E in mm of the small diameter portion satisfy the following inequalities and ratios:

$$A \geqq 65$$

$$E \leqq 3.4$$

$$C/E \geqq 1.16$$

$$C/B \leqq 0.47$$

$$D/A \geqq 0.09, \text{ and}$$

wherein as viewed on a plane which is perpendicular to the axial direction and on which a front end face of the insulator is projected, a distance between the center of a projected outer circumference of the front end face of the insulator and the center of a projected circumference of the opening of the axial bore is less than 0.07 mm.

3. A spark plug comprising, in combination, an insulator having an axial bore which receives a center electrode, a terminal electrically connected to one end of the center electrode and a spark discharge gap at another end of the center electrode, the insulator defining an axial length A in millimeters, a rear trunk portion having an outside diameter B in millimeters located rearwardly of a portion of the insulator having a maximum outside diameter, the axial bore of the insulator defining a large diameter portion having a diameter C in millimeters, an axial length D in millimeters and a small diameter portion having a diameter E in millimeters, and wherein the following inequalities are satisfied:

$$A \geqq 80$$

$$E \leqq 3.4$$

$$0.01(17.527+0.141A-0.285B-6.124C-0.14D+1.105E)<0.07.$$

* * * * *